US010600396B2

(12) United States Patent
Han

(10) Patent No.: US 10,600,396 B2
(45) Date of Patent: Mar. 24, 2020

(54) MUSIC BOX DEVICE

(71) Applicant: Gyu Lak Han, Yongin-si (KR)

(72) Inventor: Gyu Lak Han, Yongin-si (KR)

( * ) Notice: Subject to any disclaimer, the term of this patent is extended or adjusted under 35 U.S.C. 154(b) by 0 days.

(21) Appl. No.: 16/346,552

(22) PCT Filed: Oct. 19, 2017

(86) PCT No.: PCT/KR2017/011604
§ 371 (c)(1),
(2) Date: May 1, 2019

(87) PCT Pub. No.: WO2018/084470
PCT Pub. Date: May 11, 2018

(65) Prior Publication Data

US 2019/0266985 A1 Aug. 29, 2019

(30) Foreign Application Priority Data

Nov. 3, 2016 (KR) ..... 10-2016-0145837

(51) Int. Cl.
*G10F 1/06* (2006.01)
*G10F 5/02* (2006.01)

(52) U.S. Cl.
CPC . *G10F 1/06* (2013.01); *G10F 5/02* (2013.01)

(58) Field of Classification Search
CPC ..... G10F 1/06; G10F 5/02
See application file for complete search history.

(56) References Cited

U.S. PATENT DOCUMENTS 6,936,757 B2 * 8/2005 Muramatsu ..... G10F 1/06 84/94.1
6,960,710 B2 * 11/2005 Segan ..... G10F 1/06 84/94.1

(Continued)

FOREIGN PATENT DOCUMENTS

JP 2006-165205 6/2006
JP 2011-128348 6/2011

(Continued)

OTHER PUBLICATIONS

International Search Report for International Application No. PCT/KR2017/011604, dated Jan. 23, 2018.

(Continued)

*Primary Examiner* — Robert W Horn
(74) *Attorney, Agent, or Firm* — Kile Park Reed & Houtteman PLLC

(57) ABSTRACT

The invention is a music box device comprising: a vibration plate(20) having vibration pins(22); striking wheels(30) slippably friction-coupled to a first shaft(31) and having striking protrusions(32)for striking the vibration pins(22) formed on a circumferential part with concave portions(33) interposed therebetween; a driving wheel(40) fixedly coupled to a second shaft(41) and having driving protrusions (42); a driving motor(4); a stopper array part(50) having stoppers(52) disposed adjacent to the striking wheels(30) and a plurality of solenoids(54) for reciprocatingly driving each of the stoppers(52); and a microcomputer(10); wherein the solenoids(54) of the stopper array part(50)are flatly wound so as to have a long hole(56) therein, and comprise coils(55) arranged so that the flat side surfaces are adjacent to each other and a movable core(57) which has a flat plate shape that is inserted into the long hole(56) in each of the (Continued)

coils(55) and has an upper end in which the stoppers(52) are attached thereto.

2 Claims, 8 Drawing Sheets

(56) References Cited

U.S. PATENT DOCUMENTS

| | | | | |
|---|---|---|---|---|
| 7,034,215 | B2 * | 4/2006 | Kaneko | G10F 1/06 84/408 |
| 7,321,090 | B2 * | 1/2008 | Meng-Suen | G10F 1/06 84/94.1 |
| 7,544,870 | B2 * | 6/2009 | White | G10F 1/06 84/94.1 |
| 9,012,749 | B2 * | 4/2015 | Ikeda | G10F 1/06 84/94.1 |
| 9,053,686 | B2 * | 6/2015 | Ikeda | G10F 1/06 |
| 2019/0266985 | A1 * | 8/2019 | Han | G10F 1/06 |

FOREIGN PATENT DOCUMENTS

| | | |
|---|---|---|
| JP | 2014-142418 | 8/2014 |
| KR | 10-2012-0095001 | 8/2012 |
| WO | 2013-022196 | 2/2013 |

OTHER PUBLICATIONS

Written Opinion for International Application No. PCT/KR2017/011604, dated Jan. 23, 2018.

* cited by examiner

MUSIC BOX DEVICE

TECHNICAL FIELD

The invention relates to a music box device, and more particularly to a music box device which can play a plurality of various music and has a compact and strong structure and operates smoothly.

BACKGROUND ART

Conventionally, a music box device, or an orgel is referred to an automatically played music instrument which comprises a vibration plate having a plurality of vibration pins corresponding to musical scale and a cylinder or a disc having a plurality of striking protrusions disposed correspondingly to musical scale and rhythm, and when the cylinder or disc turns, the striking protrusion strikes the vibration pin of the vibration plate timely to generate sound. The music box device is generally made to generate pure and clear sound and have a decorative case.

Recently, a new type music box device is introduced in which operating timing of the striking protrusion to strike the vibration pin is controlled by a microcomputer which store MIDI data so that a plurality of music can be played. This type of music box generally includes a plurality of striking wheels densely arranged correspondingly to the vibration pins of the vibration plate, and a plurality of solenoids densely arranged correspondingly to the striking wheels. This type music box device generally comprises many parts of vibration pin striking mechanism inclusive of the solenoids corresponding to the plurality of striking wheels, and its structures is also complicated, so it is difficult to achieve a music box device which can operate smoothly with compact, rigid and durable structure.

DISCLOSURE

Technical Problem

The invention is proposed to solve the above problems, and the object of the invention is to provide a music box device which has an operating mechanism including a plurality of solenoids operating accordingly to MIDI data stored in memory of a microcomputer, and a plurality of striking wheels operated by the solenoids, and can operate smoothly with compact, rigid and durable structure.

Technical Solution

According to an aspect of the invention, there is provided a music box device which comprises:

a vibration plate 20 disposed on one side of the body 1 and on which a plurality of vibration pins 22 are arranged;

a plurality of striking wheels 30 which are disposed adjacent to the vibration pins 22 and slippably friction-coupled to a first shaft 31 and have striking protrusions 32 for striking the vibration pins 22 formed on a circumferential part with concave portions 33 interposed therebetween;

a driving wheel 40 which is disposed adjacent to the striking wheels 30 and rotated while being fixedly coupled to a second shaft 41, and has a plurality of driving protrusions 42 formed on a circumferential part thereof such that, when the driving protrusions 42 are engaged with the striking protrusions 32 of the striking wheels 30, then the driving wheels 40 rotates the striking wheels 30, while the driving protrusions 42 face on the concave portions 33, then the driving wheels 40 rotate idle;

a driving motor 4 coupled operatively to the first shaft 31 and the second shaft 41;

a stopper array 50 comprising a plurality of stoppers 52 disposed adjacent to the striking wheels 30 and selectively engaged with the striking protrusions 32 to stop and allow rotating of the striking wheels 30, and a plurality of solenoids 54 for reciprocatingly driving each of the stoppers 52;

and a microcomputer 10 to control the operating timing of the solenoids 54 according to MIDI data; wherein the solenoids 54 of the stoppers array parts 50 comprises a plurality of coils 55 which are flatly wound so as to have a elongated hole 56 therein, and arranged so that flat side surfaces are adjacent to each other, and a movable core 57 which has a flat plate shape that is inserted into the elongated hole 56 in each of the coils 55 and has an end in which the stoppers 52 are attached thereto or integrally formed therewith, the stopper arrays 50 includes a solenoid support 60 disposed on the body 1 and a plurality of solenoids 54 are arranged on it in parallel, a plurality of guide pins 62 disposed on the solenoid support 60 in parallel correspondingly to each solenoid, and a plurality of sliders 65 which are attached to the movable core 57 and slidably engaged with the guide pins 62 and have the stopper 52 formed on the front end of it.

According to the other aspect of the invention, there is provided a music box device wherein, a rotating claw 58 is provided between the stopper 52 of the slider 65 and the striking wheel 30, so that the linearly moving stopper 52 rotates the rotating claw 58 to engage with the striking protrusion 32 of the striking wheel 30 to stop the striking wheel 30 rotating or retreat from the striking protrusion 32 to allow the striking wheel 30 to rotate.

Advantageous Effect

According to the invention wherein the music box device comprising a vibration plate 20 on which a plurality of vibration pins 22 are arranged, a plurality of striking wheels 30 which are slippably friction-coupled to a first shaft 31 and have striking protrusions 32, a driving wheel 40 which is rotated while being fixedly coupled to a second shaft 41, and has a plurality of driving protrusions and a stopper array 50 having a plurality of stoppers 52 disposed adjacent to the striking wheels 30 and a plurality of solenoids 54 for reciprocatingly driving each of the stoppers 52, as the solenoids comprises a plurality of coils 55 flatly wound so as to have a elongated hole 56 therein and arranged so that flat side surfaces are adjacent to each other, and a movable core 57 which has a flat plate shape that is inserted into the elongated hole 56 in each of the coils 55, the disposition interval of the solenoids can be reduced in comparation with the circularly wound solenoid having equivalent winding number, length or equivalent electromagnetic force so that the solenoids 54 can be arranged in a narrow space correspondingly to the interval of the densely disposed vibration plates 20 or striking wheels, 30, so the compact structure of the stopper array 50, and the compact music box device can be achieved.

And, according to the invention, as the solenoids 54 are arranged on the solenoid support 60 in parallel, the guide pins 62 are disposed on the solenoid support 60 in parallel correspondingly to each solenoid, and the sliders 65 which are attached to the movable core 57 and slidably engaged with the guide pins 62 and have the stopper 52 formed on the front end of it, a plurality of solenoids 54 can be compactly arranged and supported, and the stoppers 52 attached to the movable cores 57 are installed on the slider 65 guided by the guide pins 62 to achieve smooth reciprocating movement and stable support.

DETAILED DESCRIPTION OF THE INVENTION

Figure 1:
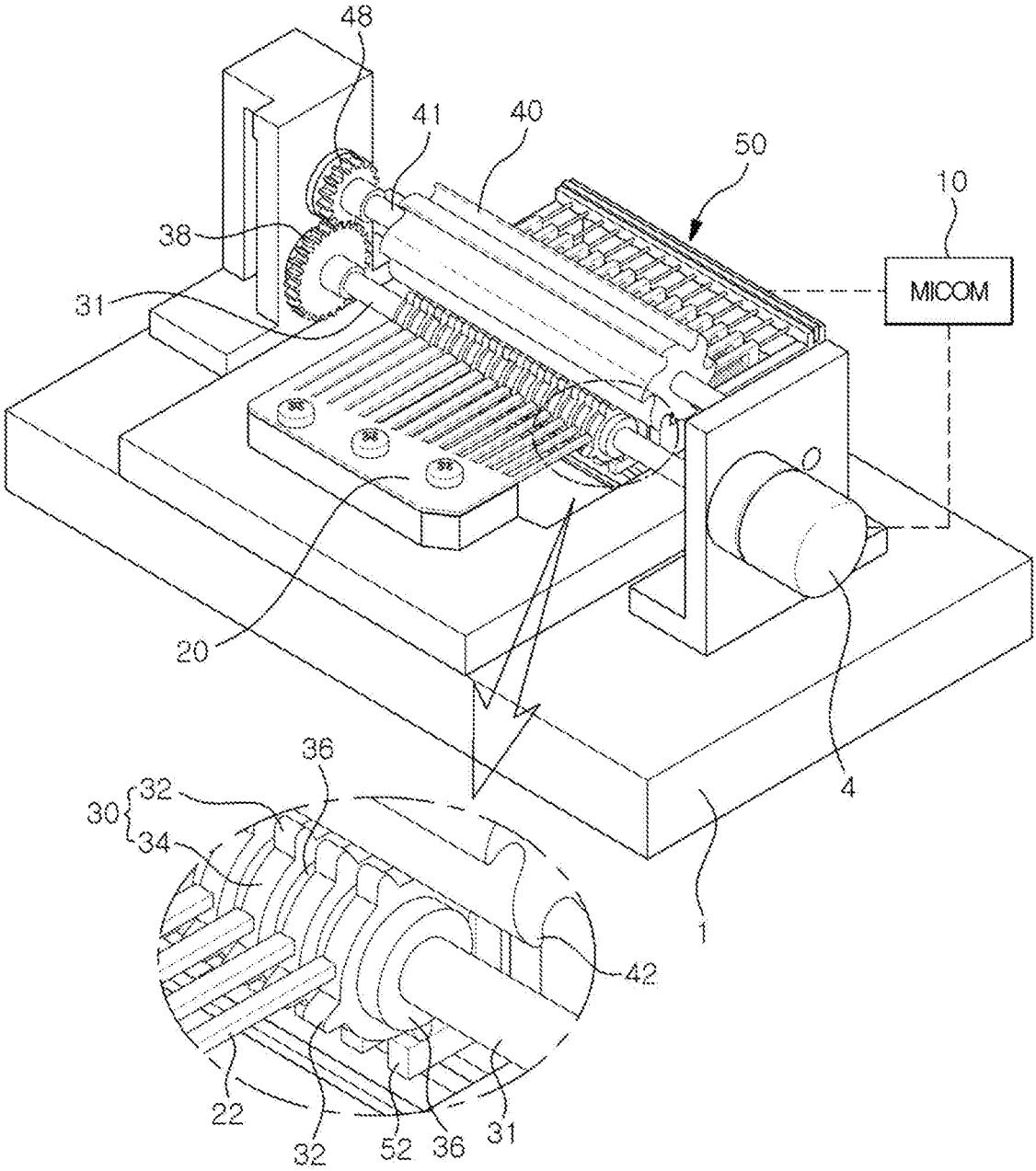
FIG. 1 is a perspective of the embodiment of the invention
Figure 2:
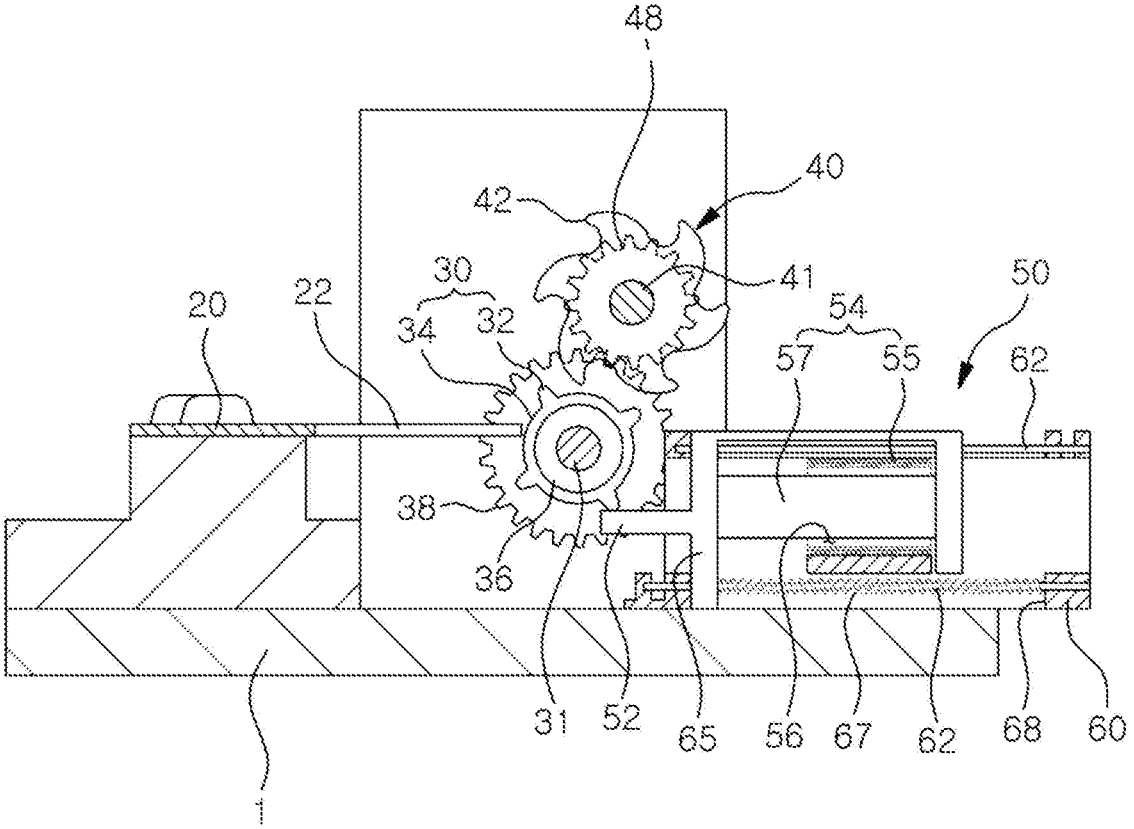
FIG. 2 is a sectional view of the embodiment of the invention
Figure 3:
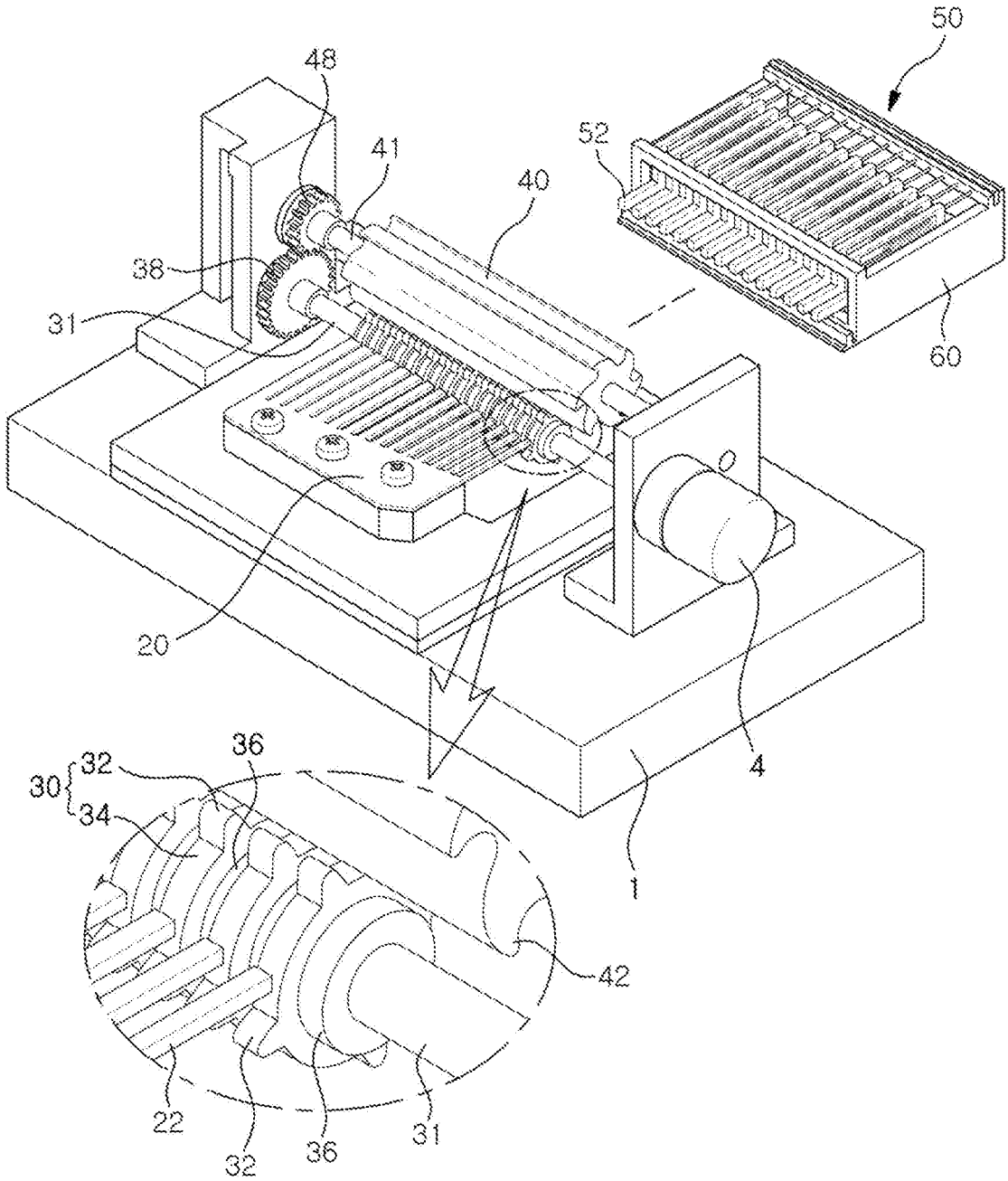
FIG. 3 is an explosive view of the embodiment of the invention

Hereinafter, the preferred embodiments of the invention will be described with reference to the drawings. FIG. 1 to FIG. 3 show one embodiment of the invention.

As shown in FIG. 1 to FIG. 3, one embodiment of the invention is provided with a vibrating plate 20 supported on the body 1 and including a plurality of vibration pins 22. Each vibration pin 22 is made of different length or width in sequence to generate sound of different scale of music.

Striking wheels 30 are disposed adjacent to each vibration pins 22 and are slippably friction-coupled to a first shaft 31 supported on the body 1. The striking wheels 30 are arranged to be engaged into the first shaft 31 as the striking wheel 30 being spaced apart to each other by a spacer 36 with the same interval. A plurality of striking protrusions 32 are formed in the same interval on a circumferential part with concave portions 33 interposed therebetween. The vibration pins 22 of the vibration plate 20 is positioned within the rotating path of the striking protrusions 32 so that the striking protrusions 32 can strike the vibration pin 22 to generate sound according to the rotation of the striking wheel 30.

According to the above construction, as mentioned below, if the striking protrusion 32 is engaged with the stopper 52, the rotation of the striking wheel 30 is stopped, but the first shaft 31 still rotates so that the first shaft 31 rotates idle against the striking wheel 30, and if the striking protrusion 32 is released from the stopper 52, the striking wheel 30 rotates with the first shaft 31 by the friction force with the first shaft 31 and strike the vibration pin 22 of the vibration plate 20 to generate sound.

A driving wheel 40 is provided adjacent to the striking wheels 30 and fixedly coupled to a second shaft 41 supported on the body 1. Preferably, the driving wheel 40 is made in the shape of roll and is provided with a plurality of driving protrusions 42 on the circumferential part thereof extending in the axial direction. The driving protrusion 42 is of the shape being curved toward the rotating direction. The curved shape of the driving protrusion is properly determined so that, if the driving protrusion 42 of the driving wheel 40 faces on the concave portions 33 of the adjacent striking wheel 30, the driving protrusion 42 is not interfered with the striking protrusion 42, and if the driving protrusion 42 faces on the striking protrusion 32, then the driving protrusion 42 is interfered with the striking protrusion 42 so as to drive the striking protrusion 42 forward.

The second shaft 41 fixed coupled to the driving wheel 40 is operatively connected to the driving motor 4. The first shaft 31 and the second shaft 41 are engaged with each other by means of the gears 38,48, so that the first shaft 31 is also driven by the motor 4.

Figure 4:
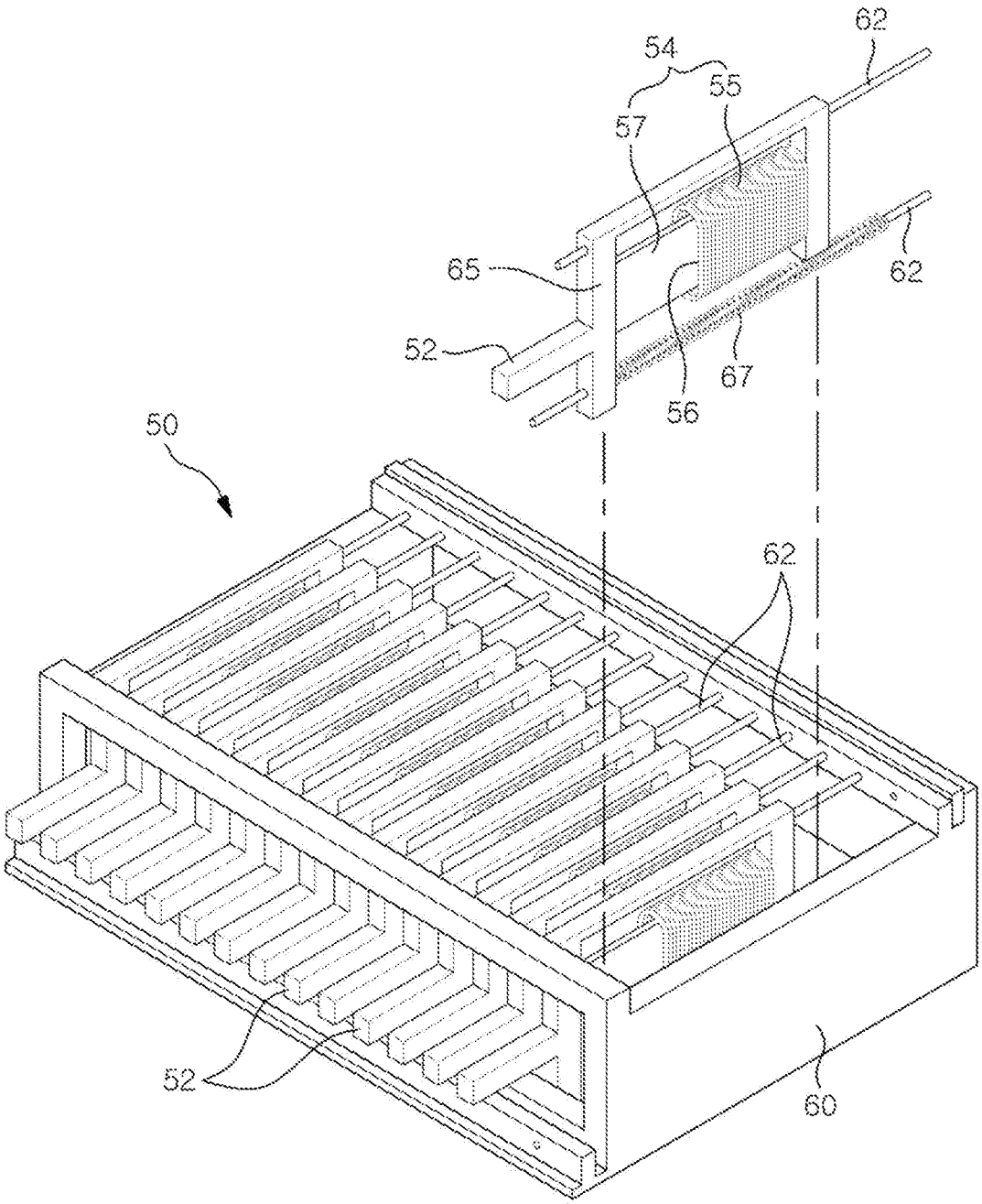
FIG. 4 is an explosive view of a part of the embodiment of the invention
Figure 5:
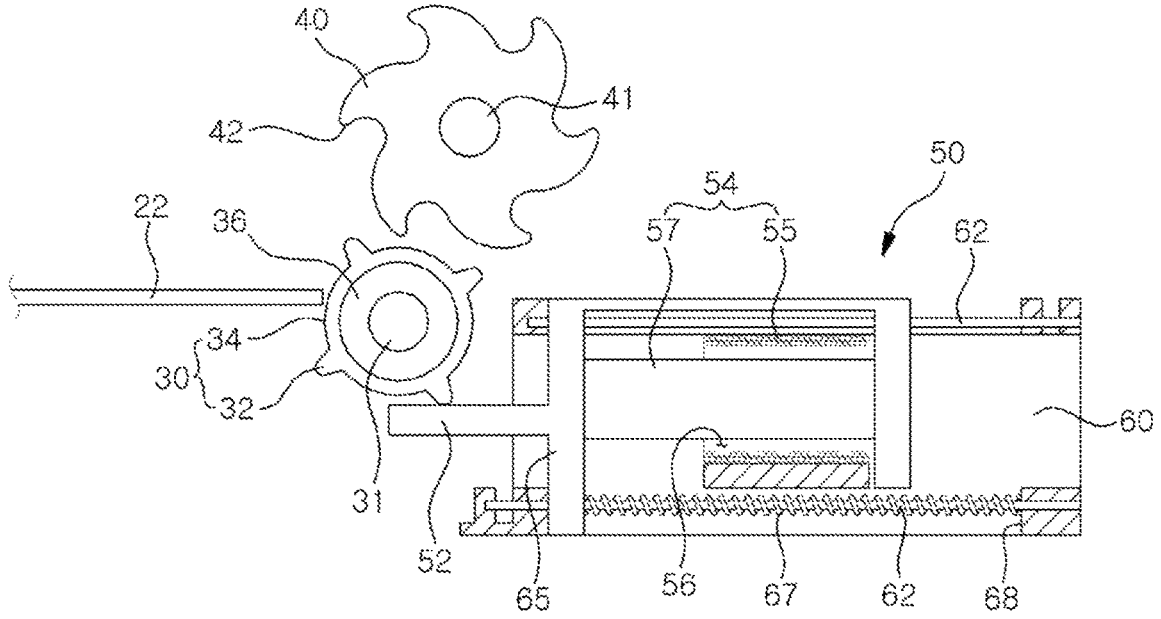
FIG. 5 is a first operational state of the embodiment of the invention
Figure 6:
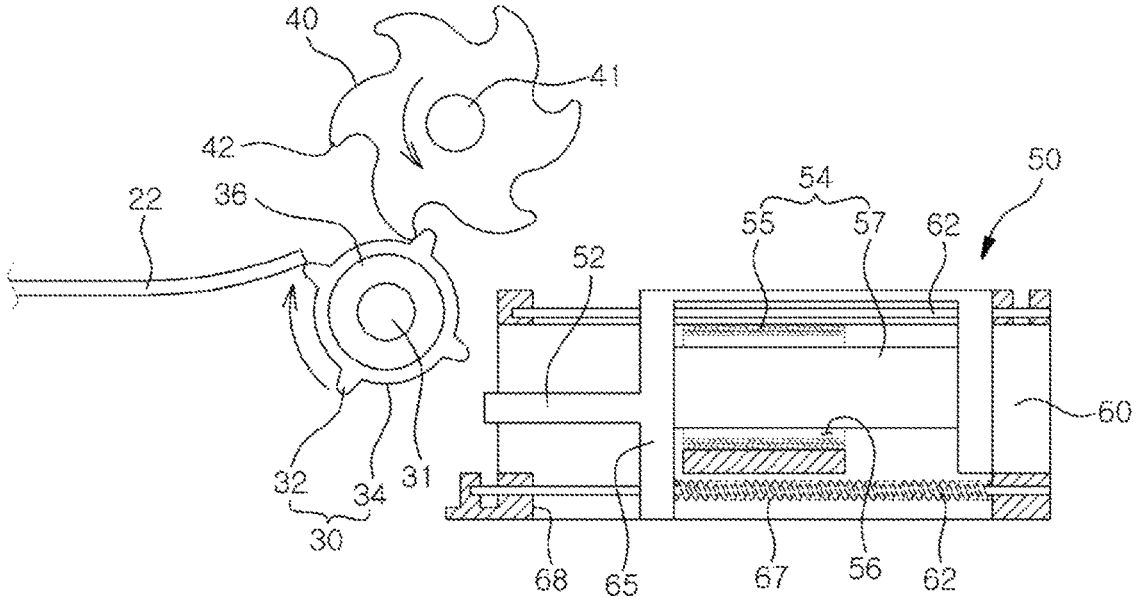
FIG. 6 is a second operational state of the embodiment of the invention

According to the invention, as shown in FIG. 4 to FIG. 6, a stopper array 50 is provided adjacent to the striking wheel 30. The stopper array 50 includes a plurality of stopper 52 disposed adjacent to the striking wheel 30 and selectively engaged with the striking protrusion 32 to stop or allow the rotation of the striking wheel 30, and a plurality of solenoids to move the stopper 52 reciprocatively. The music box device should include the striking wheels 30 as many as the number of the vibration pins 22 of the vibration plate 20, and each striking wheel 30 also includes one stopper 52 and one solenoid 54, so the number of the solenoid 54 should be increased. Therefore, in order to achieve a compact music box device, the size of the solenoid 54 should be small but it should generate enough electromagnetic force for a clear sound.

For this, according to the invention, the solenoid 54 of the stopper array 50 is made of a plurality of coils 55 wound flatly to form an elongated hole 56, and the coils 55 are arranged so that flat side surfaces are adjacent to each other, which make it possible to narrow the installing interval of the solenoids 50 effectively. And a flat movable core 57 is inserted into the elongated hole 56 of the solenoid 54 and can be moved reciprocatively in the elongated hole 56. The above-mentioned stopper 52 is installed at the front end of the movable core 57. The stopper 52 can be attached to the movable core 57 or it can be made integral to the movable core 57 so that the front end of the movable core 57 functions as a stopper.

For now, the detailed construction of the stopper array 50 will be explained below. A solenoid support 60 is installed on one side of the body 1 of the music box device. On the solenoid support 60, the above-mentioned flat type solenoids 54 are arranged in parallel so that the flat side of the solenoid 54 being faced to each other. A plurality of guide pins 62 are engaged on the solenoid support 60 above and below the solenoids 54. And a plurality of sliders 65 engaged with the movable cores 57 integrally are slidably engaged with the guide pins 62. A coil spring 67 is elastically installed on the upper guide pin 62 between the slider 65 and the solenoid support 60, so that, if electric power is applied on the solenoid 54, the movable core 57 will retreat together with the slider 65 against the elastic force of the coil spring 67, and if the electric power is off, the movable core 57 will move forward together with the slider 65 by the elastic force of the coil spring 67. At the front end of the slider 65 is provided the stopper 52 of the bar shape as mentioned above. This slider 65 is moved reciprocatively as being guided by the guide pins 65, and the slider 65 is also guided along the guide groove 68 formed on the lower part of the solenoid support 60.

According to the invention, a microcomputer 10 is provided on the body 1 to communicate the various MIDI data with outer devices and stores on the embedded memory, and can control the operating timing of the solenoid 54 according to the MIDI data.

Hereinafter, the operation of the invention having the above-mentioned construction is described. If electric power is applied to the music box device for playing music, the driving motor 4 will rotate the first shaft 31 and the second shaft 41. Then the striking wheel 30 will be in the state of selective rotation that it stops from rotating if it is interfered with the stopper 52, and it rotates if it not interfered with the stopper 52. And the driving wheel 40 fixedly coupled to the second shaft 41 will be in the state of rotating.

For now, the operation of the striking wheel 30 is describe below. If strike signal for a predetermined vibration pin 22 is not output from the microcomputer 10, as shown in FIG. 5, the solenoid 54 corresponding to that vibration pin 22 is not energized, so it is not activated. Then, the movable core 57 of that solenoid 54 is kept in advanced state by the elastic force of the coil spring 67, accordingly the corresponding slider 65 and its stopper 52 are also advanced, so the stopper 52 is engaged with the striking protrusion 32 of the striking wheel 30 to restrict rotating of the striking wheel 30. Then, even though the first shaft 31 rotates 31, the striking wheel 30 is slipped against the first shaft 31 and would not rotate. At that time, the driving protrusion 42 of the driving wheel 40 is in the state of facing on the concave portion 33 of the striking wheel 30, and the striking protrusion 32 cannot rotate to strike the vibration pin 22, so the sound cannot be generated.

In this state, if the microcomputer 10 generates a strike signal for a predetermined vibration pin 22, the corresponding solenoid 54 is energized, and as shown in FIG. 6, the corresponding movable core 57 is retreated against the elastic force of the coil spring 67. Then the corresponding slider 65 and its stopper 52 are also retreated, so the striking wheel 30 slippably friction-coupled to the first shaft 31 starts to rotate together with the first shaft 31. Then the striking protrusion 32 is engaged with the driving protrusion 42 of the driving wheel 40, so the powerful driving force of the driving wheel 40 is transferred to the striking wheel 30, accordingly, the striking protrusion 32 of the striking wheel 30 strikes the adjacent vibration pin 22 to generate sound. Then, the electric power of that solenoid 54 is switched off, so the stopper 52 is again advanced by the elastic force of the coil spring 67, and the next striking protrusion 32 is prevented from rotating, so it cannot strike the corresponding vibration pin 22 and waits to next striking signal.

Figure 7:
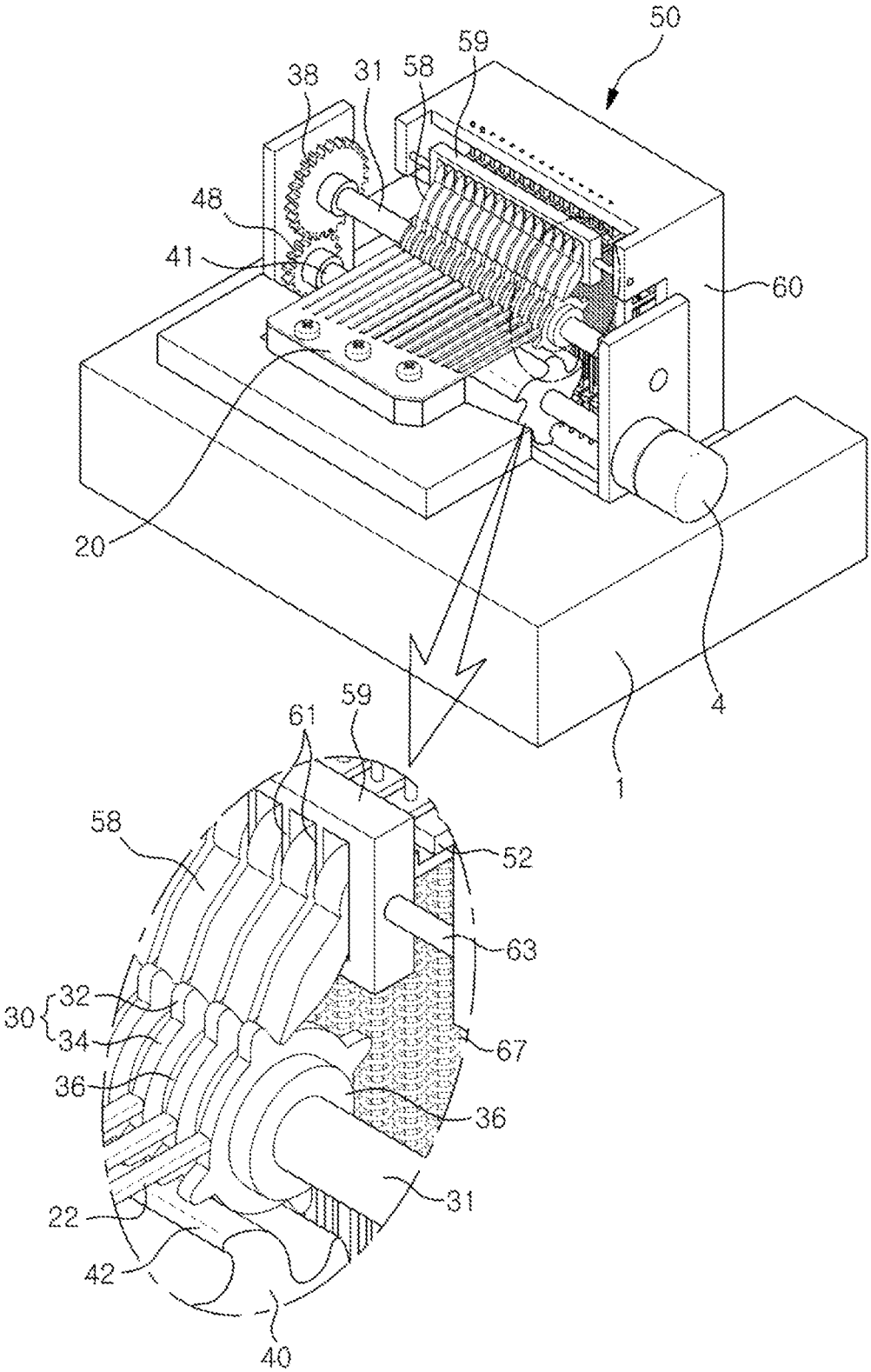
FIG. 7 is the view of the other embodiment of the invention
Figure 8:
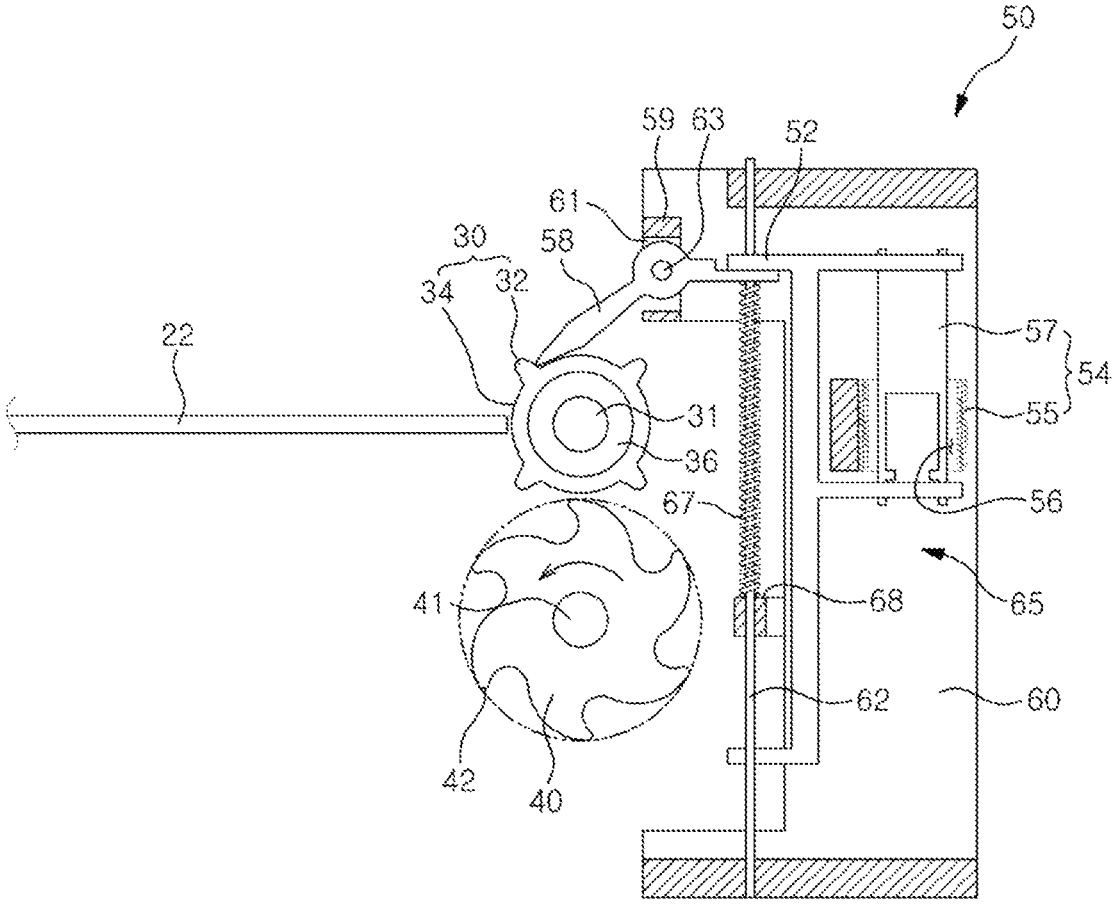
FIGS. 8 and 9 are the operational view of the embodiment of the invention
Figure 9:
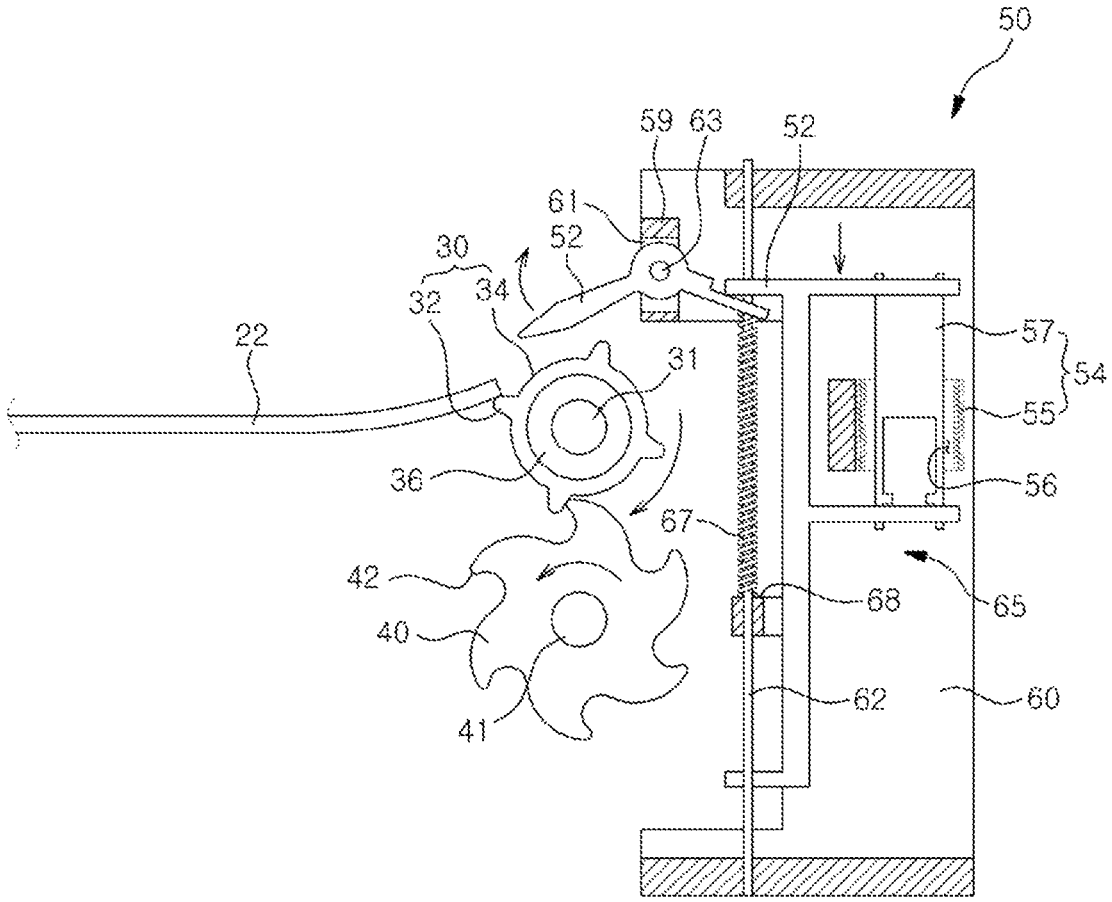

FIG. 7 shows the other embodiment of the invention, and FIG. 8 and FIG. 9 show the operation states. This embodiment is similar to the above-mentioned embodiment. But, in this embodiment, the stopper array 50 is placed uprightly for compact structure of the music box device. Accordingly, the movable core 57 and the slider 65 moves along the up and down direction, and the stopper 65 is dispositioned at the upper of the slider 65. And the driving wheel 40 is positioned at the lower side of the stopper array 50, and the striking wheel 30 is positioned at the upper of the driving wheel adjacently. A rotating claw 58 having a pair of arms is rotatably dispositioned between the stopper 52 of the slider 65 and the striking wheel 30. The rotating claws 58 is inserted between the spacer 61 of the spacer frame 59 which is in the shape of comb to keep the space, and they are supported by the supporting shaft 63 extending the space frame 59 transversely. Accordingly, the stopper 52, while in the up-down movement, touches the arm of one side of the rotating claw 58 and incur rotating of the rotating claw 58, then the arm of the other side of the rotating claw 58 will be engaged with the striking protrusion 32 of the striking wheel 30 to stop rotating of the striking wheel 30, or be retreated from the striking protrusion 32 of the striking wheel 30 to allow rotating of the striking wheel 30.

The invention claimed is:

1. A music box device which comprises:

a vibration plate (20) disposed on one side of the body (1) and on which a plurality of vibration pins (22) are arranged;

a plurality of striking wheels (30) which are disposed adjacent to the vibration pins (22) and slippably friction-coupled to a first shaft (31) and have striking protrusions (32) for striking the vibration pins (22) formed on a circumferential part with concave portions (33) interposed therebetween;

a driving wheel (40) which is disposed adjacent to the striking wheels (30) and rotated while being fixedly coupled to a second shaft (41), and has a plurality of driving protrusions (42) formed on a circumferential part thereof such that, when the driving protrusions (42) are engaged with the striking protrusions (32) of the striking wheels (30), then the driving wheels (40) rotates the striking wheels (30), while the driving protrusions (42) face on the concave portions (33), then the driving wheels (40) rotate idle;

a driving motor (4) coupled operatively to the first shaft (31) and the second shaft (41);

a stopper array (50) comprising a plurality of stoppers (52) disposed adjacent to the striking wheels (30) and selectively engaged with the striking protrusions (32) to stop and allow rotating of the striking wheels (30), and a plurality of solenoids (54) for reciprocatingly driving each of the stoppers (52); and a microcomputer (10) to control the operating timing of the solenoids (54) according to MIDI data;

wherein the solenoids (54) of the stoppers array parts (50) comprises a plurality of coils (55) which are flatly wound so as to have an elongated hole (56) therein, and arranged so that flat side surfaces are adjacent to each other, and a movable core (57) which has a flat plate shape that is inserted into the elongated hole (56) in each of the coils (55) and has an end in which the stoppers (52) are attached thereto or integrally formed therewith, the stopper array (50) includes a solenoid support (60) disposed on the body (1) and a plurality of solenoids (54) are arranged on it in parallel, a plurality of guide pins (62) disposed on the solenoid support (60) in parallel correspondingly to each solenoid, and a plurality of sliders (65) which are attached to the movable core (57) and slidably engaged with the guide pins (62) and have the stopper (52) formed on the front end of it.

2. A music box device of claim 1, wherein, a rotating claw (58 is provided between the stopper (52) of the slider (65) and the striking wheel (30), so that the linearly moving stopper (52) rotates the rotating claw (58) to engage with the striking protrusion (32) of the striking wheel (30) to stop the striking wheel (30) rotating or retreat from the striking protrusion (32) to allow the striking wheel (30) to rotate.

* * * * *